US006422959B1

(12) United States Patent
Hsu

(10) Patent No.: US 6,422,959 B1
(45) Date of Patent: Jul. 23, 2002

(54) TWIN FLYING DISCS

(76) Inventor: Kevin Hsu, No. 13, Alley 3, Lane 17, Tung An Road, Tainan (TW)

( * ) Notice: Subject to any disclaimer, the term of this patent is extended or adjusted under 35 U.S.C. 154(b) by 0 days.

(21) Appl. No.: 09/702,994

(22) Filed: Oct. 31, 2000

(51) Int. Cl.[7] ..... A63H 27/00
(52) U.S. Cl. ..... 473/588; 446/46
(58) Field of Search ..... 473/569, 588, 473/589, 613; 446/46, 48, 49

(56) References Cited

U.S. PATENT DOCUMENTS 3,855,728 A * 12/1974 Hynds ..... 473/588
4,241,533 A * 12/1980 Newsome ..... 446/46
5,098,109 A * 3/1992 Wayne ..... 446/49
5,123,869 A * 6/1992 Schipmann ..... 446/46
5,195,916 A * 3/1993 Her ..... 446/46
5,261,846 A * 11/1993 Hanna ..... 446/46
5,263,819 A * 11/1993 O'leary et al. ..... 446/48
5,480,334 A * 1/1996 Wilson et al. ..... 446/46

* cited by examiner

*Primary Examiner*—Steven Wong
(74) *Attorney, Agent, or Firm*—Rosenberg, Klein & Lee

(57) ABSTRACT

Twin flying discs are provided that include a first flying disc and a second flying disc separably fitted in the first flying disc. The first flying disc has a soft ring-shaped part and an intermediate cloth covering a central space of the ring-shaped part. The second flying disc has a soft ring-shaped part and an intermediate cloth covering a central space of the second ring-shaped part. The outer diameter of the second ring-shaped part is slightly smaller than the inner diameter of the first ring-shaped part, such that the second flying disc does not separate from the first flying disc until the combined discs are thrown in the air at a suitable speed.

4 Claims, 3 Drawing Sheets

TWIN FLYING DISCS

BACKGROUND OF THE INVENTION

The present invention relates to twin flying discs which are usable as a tool, and particularly to flying discs that are safe and can increase the joy associated with a throwing and catching game.

Many people like to play the game of throwing and catching flying discs on a lawn. And, the game of throwing and catching flying discs is known to be one of the most suitable games for play between parents and their children.

However, a conventional flying disc for such purpose has only one disc part, and is thrown and caught between two people or among several people. Such a game becomes boring after a short period of time, and cannot produce much joy for the people playing it.

SUMMARY OF THE INVENTION

Therefore, it is a main object of the present invention to provide a flying disc arrangement of the kind which has a first flying disc and a second flying disc separably connected to each other such that the flying disc arrangement can be separated into two flying discs, due to centrifugal force and gravity, when thrown in the air to increase the joy for the people playing therewith.

The twin flying discs of the present invention include a first flying disc and a second flying disc.

The first flying disc has a ring-shaped part made of a soft material and an intermediate cloth connected to the ring-shaped part, covering a central space of the ring-shaped part. The ring-shaped part further has a protection layer.

The second flying disc has a ring-shaped part made of a soft material, and an intermediate cloth connected to the second ring-shaped part. The second ring-shaped part further has a protection layer. The outer diameter of the second ring-shaped part is at least slightly smaller than the inner diameter of the first ring-shaped part such that the second flying disc can be separably fitted in the first flying disc. When the twin flying discs are thrown in the air, the flying discs can separate from each other, and fly to different places.

BRIEF DESCRIPTION OF THE DRAWINGS

This invention will be better understood by referring to the accompanying drawings, wherein.

DESCRIPTION OF THE PREFERRED EMBODIMENTS

Figure 1:
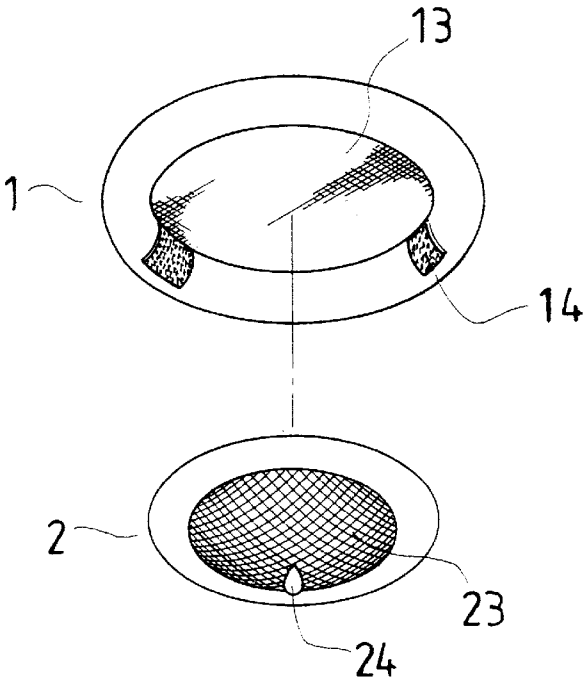
FIG. 1 is an exploded perspective view of the twin flying discs according to the first embodiment of the present invention.
Figure 2:
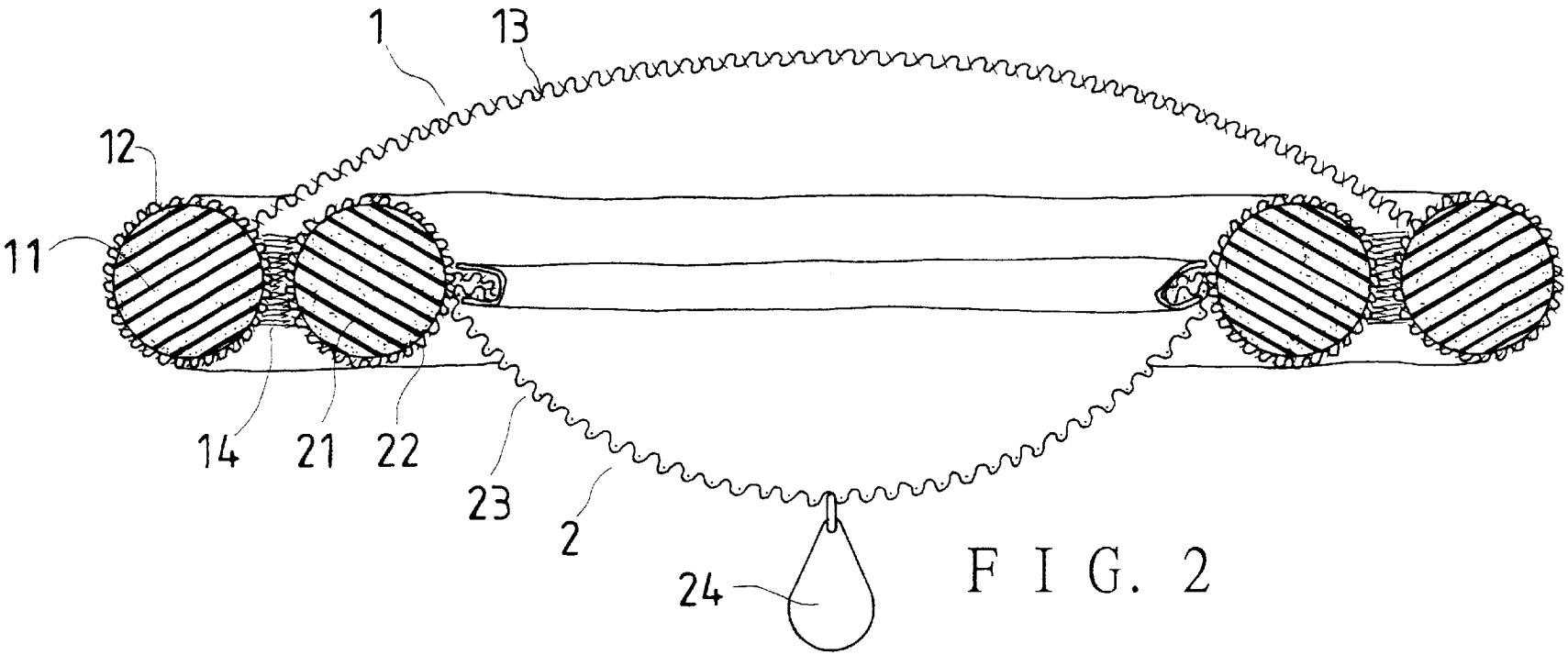
FIG. 2 is a cross-section view of the twin flying discs according to the first embodiment of the present invention.

Referring to FIGS. 1 and 2, a flying disc arrangement according to a first embodiment of the present invention includes a first flying disc 1 and a second flying disc 2.

The first flying disc 1 has a ring-shaped part 11 and an intermediate cloth 13 connected to the ring-shaped part 11 to cover a central space of the ring-shaped part 11. The ring-shaped part 11 is made of soft material, and has a protection layer 12 applied thereon. Several rough cloths 14 are fitted to an inner side of the ring-shaped part 11.

The second flying disc 2 includes a ring-shaped part 21 and an intermediate cloth 23 connected to the ring-shaped part 21 to cover a central space of the ring-shaped part 21. The ring-shaped part 21 is made of soft material, and has a protection layer 22 applied thereon. A weight 24 is connected to a central portion of a lower side of the cloth 23. The outer diameter of the second flying disc 2 is slightly smaller than the inner diameter of the first flying disc 1. The second flying disc 2 is disposed within the first flying disc 1 under the intermediate cloth 13, with the outer side of the second flying disc held by the rough cloths 14 of the first flying disc 1 due to friction. Thus, the second flying disc 2 is releasably secured in the first flying disc 1 by the rough cloths 14.

When the twin flying discs are thrown to the air, the first and the second flying discs 1 and 2 will separate from each other due to centrifugal force and gravity, and fly to different places. The weight 24 helps the second flying disc 2 fly more smoothly.

Figure 5:
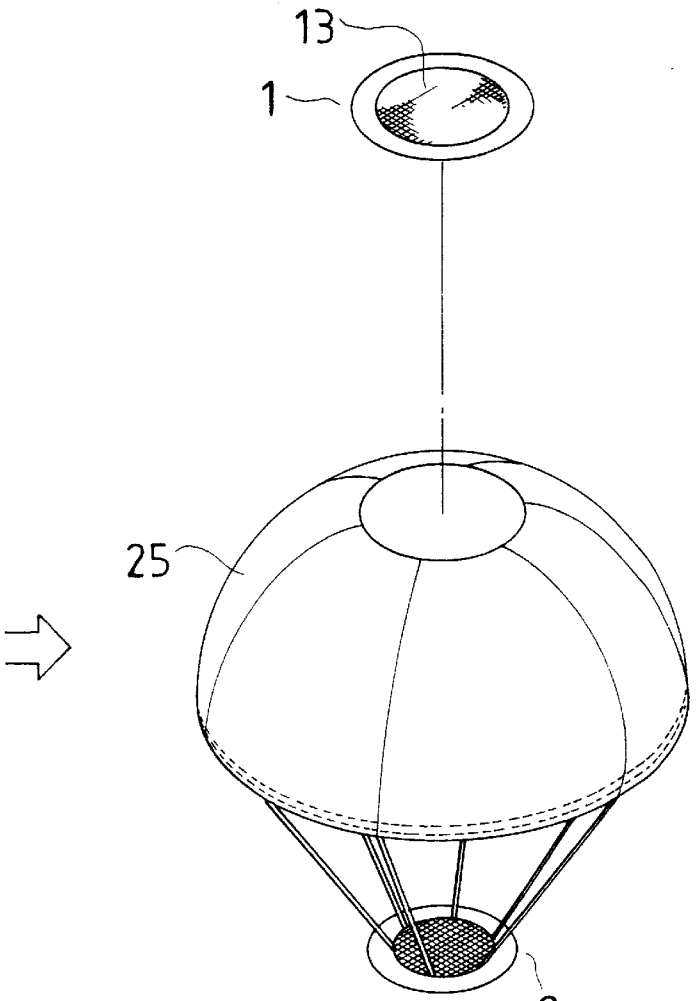
FIG. 5 is a diagrammatic view showing the flying discs flying in the air with the parachute of the second flying disc being deployed.
Figure 4:
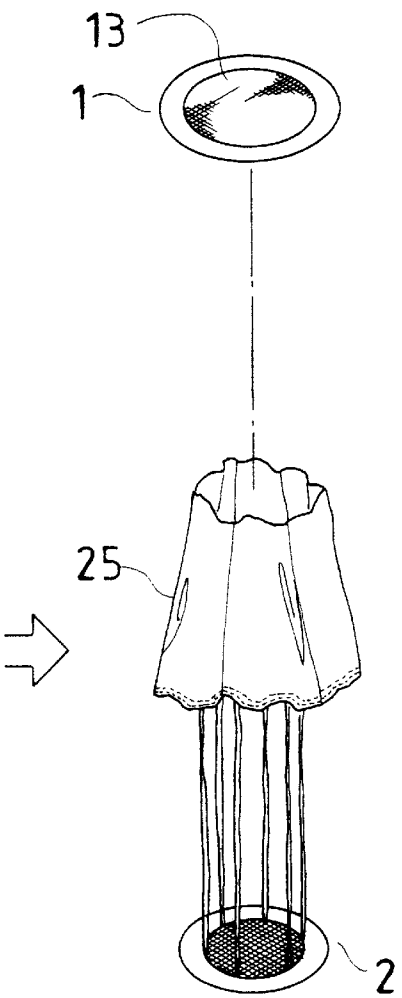
FIG. 4 is a diagrammatic view showing the flying discs flying in the air with the second flying disc separated from the first one.
Figure 3:
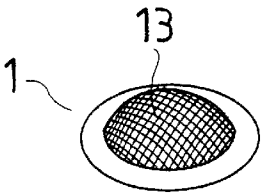
FIG. 3 is a diagrammatic view showing the twin flying discs flying in the air according to the second embodiment of the present invention.

Referring to FIGS. 3, 4 and 5, according to a second embodiment of the present invention, the second flying disc 2 is provided with a parachute 25, such that the second flying disc 2 can fall through the air slowly when the twin flying discs are thrown through the air.

Figure 6:
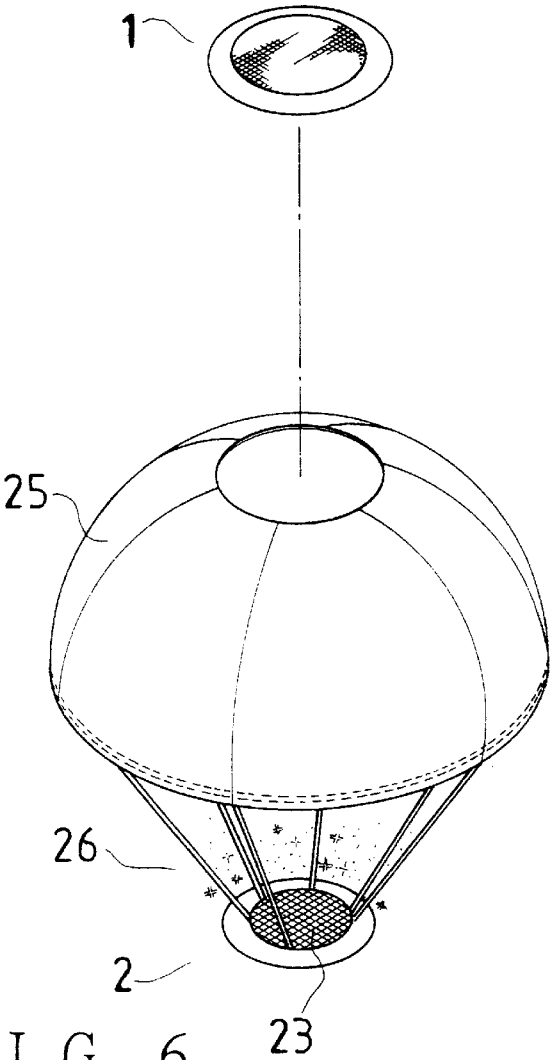
FIG. 6 is a diagrammatic view showing the flying discs flying in the air with the sparkling pieces of paper being dispersed to the air.

Referring to FIG. 6, the cloth 23 of the second flying disc 2 is replaced with a mesh. Sparkling pieces of paper 26 or other objects that can waft in the air are held on the mesh 23. Thus, the sparkling pieces of paper 26 can fall slowly through the air when the second flying disc 2 separates from the first flying disc 1 in flight. The holes in the mesh 23 permit wind to flow therethrough to aid the sparkling pieces of paper 26 in being dispersed from the second flying disc 2.

From the above description, the twin flying discs of the present invention is shown to have the following features.

1. The first and the second flying discs can be played together as described above or separably as in the conventional flying disc.
2. The twin flying discs can separate in the air, and fly to different places, greatly increasing the joy for the people playing therewith.
3. The parachute of the second flying disc can provide even more joy for those playing with the flying discs.
4. The sparkling pieces of paper can make the scene look beautiful as they fall slowly through the air, and are suitable for use at parties or festivals.
5. Referring to FIG. 2, the twin flying discs, when combined together, has a flying saucer shape which can help the combined structure fly relatively high and far.
6. Both the first and the second flying discs are respectively made of a soft material, so the twin flying discs are very safe, and can be used indoors.

What is claimed is:

1. A twin flying disc arrangement, comprising:

a first flying disc, said first flying disc including (a) a first ring-shaped part made of a soft material, (b) a first intermediate cloth connected to said first ring-shaped part and covering a central space of said first ring-shaped part, (c) a first protection layer disposed on said first ring-shaped part, and (d) a plurality of rough cloths disposed on an inner side of said first ring-shaped part; and, a second flying disc, said second flying disc including (a) a second ring-shaped part made of a soft material, said second ring-shaped part having an outer diameter less than an inner diameter of said first ring-shaped, said second flying disc being releasably engaged with said first flying disc by frictional contact with said plurality of rough cloths (b) a second intermediate cloth connected to said second ring-shaped part and covering a central space of said second ring-shaped part, and (c) a second protection layer disposed on said second ring-shaped part, wherein said second flying disc is separable from said first flying disc to fly to a different location when said first and second flying discs are thrown together.

2. The twin flying disc arrangement as claimed in claim 1, wherein said second flying disc has a weight connected to a central portion of said second intermediate cloth.

3. A twin flying disc arrangement, comprising:

a first flying disc, said first flying disc including (a) a first ring-shaped part made of a soft material, and (b) a first intermediate cloth connected to said first ring-shaped part and covering a central space of said first ring-shaped part; and, a second flying disc, said second flying disc including (a) a second ring-shaped part made of a soft material, said second ring-shaped part having an outer diameter less than an inner diameter of said first ring-shaped, said second flying disc being releasably engaged with said first flying disc, (b) a second intermediate cloth connected to said second ring-shaped part and covering a central space of said second ring-shaped part, and (c) a parachute connected to said second ring-shaped part for permitting said second flying disc to fall slowly when thrown, wherein said second flying disc is separable from said first flying disc to fly to a different location when said first and second flying discs are thrown together.

4. A twin flying disc arrangement, comprising:

a first flying disc, said first flying disc including (a) a first ring-shaped part made of a soft material, and (b) a first intermediate cloth connected to said first ring-shaped part and covering a central space of said first ring-shaped part; and, a second flying disc, said second flying disc including (a) a second ring-shaped part made of a soft material, said second ring-shaped part having an outer diameter less than an inner diameter of said first ring-shaped, said second flying disc being releasably engaged with said first flying disc, (b) a second intermediate cloth connected to said second ring-shaped part and covering a central space of said second ring-shaped part, said second intermediate cloth being formed by a mesh material, and (c) a plurality of sparkling pieces of paper held on said second intermediate cloth, wherein said second flying disc is separable from said first flying disc to fly to a different location when said first and second flying discs are thrown together.

* * * * *